US009711342B2

(12) United States Patent
Kuepper et al.

(10) Patent No.: US 9,711,342 B2
(45) **Date of Patent: *Jul. 18, 2017**

(54) GAS-DISCHARGE LAMP

(75) Inventors: Lukas Kuepper, Aachen (DE); Michael Haacke, Aachen (DE); Klaus Schoeller, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/698,853

(22) PCT Filed: May 19, 2011

(86) PCT No.: PCT/IB2011/052200

§ 371 (c)(1),
(2), (4) Date: Nov. 19, 2012

(87) PCT Pub. No.: WO2011/148301

PCT Pub. Date: Dec. 1, 2011

(65) Prior Publication Data

US 2013/0063949 A1 Mar. 14, 2013

(30) Foreign Application Priority Data

May 26, 2010 (EP) ..... 10163954

(51) Int. Cl.
*H01J 61/35* (2006.01)
*F21S 8/10* (2006.01)
(Continued)

(52) U.S. Cl.
CPC ..... *H01J 61/35* (2013.01); *F21S 48/1186* (2013.01); *F21S 48/1358* (2013.01);
(Continued)

(58) Field of Classification Search
CPC .... H01J 61/35; H01J 5/08; H01J 5/10; H01K 1/30; H01K 1/32; H01K 1/325;
(Continued)

(56) References Cited

U.S. PATENT DOCUMENTS 4,794,297 A 12/1988 Gaugel et al.
5,646,471 A * 7/1997 Scholler et al. ..... 313/25
(Continued)

FOREIGN PATENT DOCUMENTS

DE 19747314 A1 5/1998
EP 0708978 B1 2/1998
(Continued)

OTHER PUBLICATIONS

"Uniform Provisions Concerning the Approval of Gas-Discharge Light Sources for Use in Approved Gas-Discharge Lamp Units of Powerdriven Vehicles", Feb. 24, 2009, United Nations, Addendum 98: Regulation No. 99 Revision 2.*
(Continued)

*Primary Examiner* — Anh Mai
*Assistant Examiner* — Arman B Fallahkhair

(57) ABSTRACT

The invention describes a gas-discharge lamp (1) comprising a vessel (5), which vessel (5) is partially coated with at least one longitudinal stripe ($S_H$, $S_H'$) arranged on the surface of the vessel (5) below a horizontal plane (P) through a longitudinal axis (X) through the centre of the lamp (1) such that, on each side of the lamp, an angle ($\beta_{H1}$, $\beta_{H2}$) subtended at the lamp centre by the horizontal plane (P) and an upper edge (16, 17) of the longitudinal stripe ($S_H$, $S_H'$) on that side of the lamp comprises at least 10°, more preferably at least 13°, most preferably at least 15°. The invention also describes a reflector (8) for a lamp (1), comprising a reflective interior surface realized to deflect light ($L_{20A}$, $L_{20B}$, $L_{21A}$, $L_{21B}$) originating from the lamp (1) outward to
(Continued)

give a specific beam profile (3) with a bright/dark cut-off line (31) and a shoulder (32), and wherein the lamp (1), in particular a lamp (1) according to any of claims 1 to 12, is positioned horizontally in the reflector (8), and wherein the reflective interior surface comprises at least one beam-shaping region (81 A, 81B) realised to deflect a portion ($L_{21A}$, $L_{21B}$) of the light ($L_{20A}$, $L_{20B}$, $L_{21A}$, $L_{21B}$), emitted from the lamp (1) between 7.5° and 15° below a horizontal plane (P), at a specific region (21A, 21B) within the beam profile (3). The invention further describes a lighting assembly (9) comprising such a reflector (8) and a lamp (1), in particular a lamp (1) according to the invention.

18 Claims, 5 Drawing Sheets

(51) Int. Cl.
*F21V 7/04* (2006.01)
*H01J 61/34* (2006.01)
*F21V 17/04* (2006.01)

(52) U.S. Cl.
CPC ..... *F21S 48/145* (2013.01); *F21V 17/04* (2013.01); *H01J 61/34* (2013.01)

(58) Field of Classification Search
CPC .. F21S 48/145; F21S 48/1358; F21S 48/1364; F21S 48/1186; F21S 8/10; F21V 17/04; B60Q 1/00
USPC ..... 362/256, 351, 255, 459–549, 296.01; 313/117, 318.11, 113, 114, 634, 635, 573; 445/22, 58
See application file for complete search history.

(56) References Cited

U.S. PATENT DOCUMENTS

| | | | | |
|---|---|---|---|---|
| 6,004,014 | A | 12/1999 | Yamamura et al. | |
| 6,168,297 | B1 * | 1/2001 | Tatsukawa | 362/351 |
| 6,281,630 | B1 * | 8/2001 | English | H01K 9/08 313/112 |
| 6,531,832 | B1 | 3/2003 | Hirata | |
| 6,534,118 | B1 | 3/2003 | Nakamura | |
| 6,583,564 | B1 * | 6/2003 | Kiryu et al. | 313/634 |
| 6,644,828 | B2 * | 11/2003 | Kinouchi | 362/214 |
| 6,698,913 | B2 * | 3/2004 | Yamamoto | 362/548 |
| 6,710,521 | B2 * | 3/2004 | Tsuda | H01J 61/38 313/113 |
| 7,183,712 | B2 * | 2/2007 | Schoeller | H01J 61/35 313/110 |
| 7,314,298 | B2 | 1/2008 | Takagaki | |
| 2005/0212434 | A1 | 9/2005 | Schoeller | |
| 2006/0076894 | A1 | 4/2006 | Ansems | |
| 2008/0116780 | A1 * | 5/2008 | Kupper et al. | 313/112 |
| 2013/0070468 | A1 * | 3/2013 | Kuepper et al. | 362/487 |

FOREIGN PATENT DOCUMENTS

| | | | |
|---|---|---|---|
| JP | H09-500489 | A | 1/1997 |
| JP | 10-040708 | A | 2/1998 |
| JP | 11232903 | A | 2/1999 |
| JP | 2005-539362 | A | 12/2005 |
| WO | 2008110967 | A1 | 9/2008 |
| WO | 2008129487 | A2 | 10/2008 |
| WO | 2009066244 | A2 | 5/2009 |

OTHER PUBLICATIONS

EPO as ISA, International Search Report and Written Opinion mailed Nov. 17, 2011 from International Application No. PCT/IB2011/052200, 19 pages.
First Office Action issued Jun. 11, 2015 from Chinese Application No. 201180026018.3.
Second Office Action issued Jan. 4, 2016 from Chinese Application No. 201180026018.3.
Office Action issued Mar. 17, 2015 from Japanese Application No. 2013-513781.
Office Action issued Jan. 6, 2015 from Japanese Application No. 2013-511770.
Second Action issued Dec. 28, 2015 from Japanese Application No. 2013-511770.
Office Action mailed Feb. 25, 2015 from EP Application No. 11724465.7
Office Action mailed Jul. 24, 2015 from EP Application No. 11724465.7.
Office Action mailed Nov. 2, 2014 from EP Application No. 11724465.7.
Grant Notification issued May 6, 2016, China Application No. 201180026018.3, 4 pages.
Office Action dated Mar. 30, 2016, European Application No. 11724465.7, 2 pages.

* cited by examiner

GAS-DISCHARGE LAMP

FIELD OF THE INVENTION

The invention describes a gas discharge lamp, a reflector, and a lighting assembly.

BACKGROUND OF THE INVENTION

High-intensity discharge lamps (HID lamps) are widely used in automotive headlamp applications, since they can provide an intensely bright light. To ensure traffic safety, characteristics of such lamps such as beam profile, colour temperature, lamp driver characteristics, lamp dimensions, etc., are specified in different countries by the appropriate regulations. For example, in Europe, the beam profile that is to be emitted by a headlamp, i.e. the shape of the low (passing) beam and the shape of the high (driving) beam, is regulated by ECE-R98, where 'ECE' stands for 'Economic Commission for Europe', while design-specific aspects of discharge light sources for use in such headlamps are regulated by ECE-R99. Often, the lamps specified in these regulations are simply referred to by their designation, e.g. 'D3S', 'D4R', etc.

An R-type lamp (e.g. a D4R lamp), for use in conjunction with a reflector in a headlamp arrangement, has opaque 'stripes' arranged on the outer vessel to block, reflect or absorb some of the light in order to obtain the desired beam shape, for example to prevent glare and to obtain the required cut-off. These stripes generally comprise a 'vertical' stripe, i.e. a stripe arranged around the circumference of the lamp near the lamp base, and 'horizontal' stripes arranged along the length of the lamp, which is mounted essentially horizontally in a reflector of a lighting assembly, as described in EP 0 708 978 B1. The horizontal stripes in such a prior art lamp are positioned relatively high up on the sides of the lamp in order to achieve a high brightness level below the cut-off and a very low brightness level above the cut-off. At the same time, these effectively block a fraction of the light, which is effectively wasted. Therefore, the overall light output and efficiency for a lamp with such stripes is noticeably lower than for a comparable lamp without stripes. This loss of light is a considerable drawback, since an automotive lamp should deliver as much light as possible into the front beam for visibility and safety reasons. The light absorbed or blocked by the stripes also contributes to an over-heating of the lamp and can result in a shortening of the lifetime of the lamp. The reason for this is that the inner vessel or burner is relatively large, for example in the case of a 35 W D4R lamp, and there is only a small clearance between the burner and the outer vessel. The glass wall of the burner is therefore very close to the glass wall of the outer vessel, and the associated coefficient of thermal conductivity is high. The high temperatures cause an increase in the lamp voltage, and therefore to a reduction in lumen output, as the lamp ages, and can also lead to the development of flicker. The temperature increase is also associated with an unfavourable alteration in the colour of the light output by the lamp. Another unwanted side effect of the high temperatures is the development of cracks in the pinch region of the lamp under the vertical stripe, which can shorten the useful lifetime of the lamp.

Therefore, it is an object of the invention to prolong the lifetime of such a lamp.

SUMMARY OF THE INVENTION

This object is achieved by the gas-discharge lamp according to claim 1, the reflector according to claim 13, and the lighting assembly according to claim 15.

According to the invention, the lamp comprises a vessel, which vessel is partially coated with at least one essentially rectangular longitudinal stripe arranged on the surface of the vessel below a horizontal plane through a longitudinal axis through the centre of the lamp such that, on each side of the lamp, an angle subtended at the lamp centre by the horizontal plane and an upper edge of the longitudinal stripe on that side of the lamp comprises at least 10°, more preferably at least 13°, most preferably at least 15°.

A gas-discharge lamp for an automotive front beam is generally mounted horizontally in an essentially parabolic reflector. An arc-image collected in the right-hand side of the reflector will be reflected upside-down—i.e. inverted—into the left-hand side of the beam profile in front of the vehicle, while an arc-image collected in the left-hand side of the reflector will be reflected upside down into the right-hand side of the beam profile. The orientation of the arc-image in the beam profile corresponds to the angle of the light emitted by the lamp with respect to a horizontal reference plane defined by the lamp's optical axis. With a horizontal lamp mounting position, the longitudinal stripe is also arranged essentially horizontally. Therefore, in the following, the longitudinal stripe may also simply be referred to as a 'horizontal' stripe. Furthermore, the terms 'stripe' and 'pin-stripe' may be used interchangeably. The term 'essentially', when used in the context of an arrangement, is to be understood to include only negligible deviations from the specified arrangement.

The inventive placement of the horizontal stripe has a number of positive effects.

For instance, the lifetime of the lamp can be favourably prolonged, since the horizontal stripe is located in a 'cooler' region of the vessel, i.e. in a region closer to the bottom of the vessel. As a result, the influence of the lower horizontal stripe on the lamp temperature is not as severe, and the temperature in the lamp does not reach the high levels reached in a prior art lamp with a wider horizontal stripe. The lower temperatures are associated with an improvement in light flux and a less pronounced increase in lamp voltage as the lamp ages, since the electrode burn-back is not as pronounced. Furthermore, because the upper edges of the horizontal stripe are positioned at a lower level compared to a prior art lamp, the horizontal stripe therefore blocks less useful light. With the smaller angular region subtended by the upper edges of the longitudinal stripe(s), i.e. the stripes are located lower down on the lamp sides, a higher luminous flux can be obtained for a front beam in the region between 25 m and 60 m in front of the vehicle, while not generating any additional glare. In prior art lamps with horizontal stripes arranged to manipulate the beam profile, light which would be emitted by the lamp in the angular region between about 7.5° and 15° below the horizontal plane is effectively blocked, while causing the temperature in the lamp to increase to an unfavourable level.

The horizontal stripe on the lamp according to the invention may favourably be combined with the circumferential or 'vertical' stripe as specified in the currently applicable regulations for automotive headlamps. In this way, the lamp according to the invention can be used in place of a prior art D4R headlamp without having to replace any existing electronics or fittings.

According to the invention, a reflector for a lamp comprises a reflective interior surface realised to deflect light originating from the lamp outward to give a specific beam profile with a bright/dark cut-off line, and wherein the lamp, in particular a lamp according to the invention, is positioned horizontally in the reflector, and wherein the reflective interior surface comprises at least one beam-shaping region realised to deflect a portion or fraction of the light, emitted from the lamp between 0° and at least 10° below a horizontal plane, at a specific region within the beam profile close to the bright/dark cut-off line. Here, the term 'positioned horizontally in the reflector' is to be understood to mean that a horizontal longitudinal axis of the lamp essentially coincides with the horizontal optical axis of the reflector. In other words, the horizontal longitudinal axis of the lamp is not tilted with respect to the horizontal optical axis of the reflector.

Also, the reflector according to the invention is preferably realised so that it can be used in place of a prior art reflector in a front beam lighting assembly. With the reflector according to the invention, one of the most relevant parts of a beam profile for an automotive front beam can be optimally illuminated while still satisfying the beam profile conditions laid out in the regulations.

According to the invention, a lighting assembly comprises such a reflector and a lamp, in particular a lamp according to the invention.

The dependent claims and the subsequent description disclose particularly advantageous embodiments and features of the invention.

Preferably, the partial coating can comprise a suitable paint such as an opaque paint applied onto a surface of a vessel of the lamp. The partial coating can be applied in any suitable manner, for example by printing a stripe of a suitable substance onto a vessel of the lamp.

In prior art lighting assemblies, the reflector design was essentially parabolic and symmetrical. However, the desired beam profile for a front beam is asymmetrical, with a 'shoulder' in which a portion of the light is projected further into the 'kerb side' of the road in order to better illuminate this critical region. Therefore, the prior art arrangement of stripes was designed to form the front beam into the desired asymmetric shape. However, advances in reflector design allow a reflector to perform a certain amount of beam shaping. In a further particularly preferred embodiment of the invention, therefore, the horizontal stripe is arranged essentially symmetrically on the vessel such that the first angle is essentially equal to a second angle subtended at the lamp centre between the horizontal plane and a point on the opposite upper edge of the horizontal stripe. In other words, the upper edges of the horizontal stripe on each side of the lamp are arranged symmetrically about the lamp, i.e. the angle subtended at the lamp centre by the horizontal plane through the lamp centre and the upper edge of the horizontal stripe on one side of the lamp is essentially the same as the angle subtended at the lamp centre by the horizontal plane through the lamp centre and the upper edge of the horizontal stripe on the other side of the lamp. For example, the angles subtended can both comprise 10°, or they can both comprise 15°, etc.

In a further preferred embodiment of the invention, the partial coating comprises a single essentially rectangular stripe, so that the entire underside of the lamp is coated with a single stripe. In this embodiment of the invention, the coldest spot temperature of the bulb is increased, so that the luminance of the lamp is increased accordingly, giving a more favourable beam performance. Furthermore, the colour temperature of the front beam appears more bluish because yellowish stray light generated by the particles of the salt pool is blocked very close to the lamp. In the state of the art the yellowish stray light is blocked by an additional metal shield that surrounds the lower part of the lamp at a distance of more than 10 mm. Part of the yellowish stray light can still escape and tint the beam pattern with unwanted yellowish colour. Also, the homogeneity of the beam, i.e. the light and colour distribution, is improved.

As already mentioned above, a prior art lamp produces a relatively low level of luminous flux owing to the higher placement of the horizontal stripes. Experiments with a lamp with stripes arranged according to the invention have shown that, unexpectedly, the extra light emitted in these regions does not cause glare if the corresponding region of the reflector is designed to reflect the light into the beam profile well within the cut-off line. The larger the angle, the more light can be reflected into an area which is further away from the cut-off line (i.e. closer to the vehicle), thereby increasing the brightness level well bellow the cut-off line. It has been widely accepted that a higher and smooth brightness gradient in the area between 10 m and 60 m in front of the vehicle ensures more relaxed and safer driving. On the other hand, if the subtended angle is significantly greater than 30° below the horizontal, the region of maximum brightness will be shifted mostly within 30 m of the vehicle. Furthermore, particularly for a 35 W lamp, the light originating from the lower regions of the lamp tends to have a yellowish tint owing to the yellowish colour of the stray light originating from the salt pool at the base of the lamp. The resulting beam profile, with the yellowish bright region near the vehicle, can result in the driver focussing his attention on this region and may be hazardous especially at higher velocities. Especially when viewed from in front, the yellowish tint gives the unwanted impression that the headlamp is a halogen headlamp.

In contrast, a 25 W lamp can provide light with a higher colour temperature even for angles in the region of 30° subtended below the horizontal. The reason for this is because of the more even temperature distribution in a 25 W lamp owing to its smaller dimensions, which result in a lower temperature gradient between the hotter upper region of the lamp and the cooler lower region of the lamp. Because of this, the light emitted by a 25 W lamp has significantly less yellowish colouration. Therefore, in a 25 W lamp design, the horizontal stripes can be placed lower down than in a 35 W lamp design.

Since the lamp according to the invention is usually used in a reflector using a baffle as described above to block some of the light emitted in a downward direction, it may not always be strictly necessary to block unwanted light using only the stripes. Therefore, in a further preferred embodiment of the invention, the partial coating comprises a pair of essentially rectangular stripes arranged longitudinally on the surface of the vessel, and the stripes are arranged such that a gap between them is situated above a baffle when the lamp is mounted in such a reflector. The stripes are preferably essentially parallel and arranged at the same height on either side of the lamp and below the horizontal plane. In this way, any light emitted through the gap between the stripes on the lamp underside is still prevented from disturbing the beam profile. At the same time, the light emitted through the gap allows the temperature in the lamp to be maintained at a favourable low level compared to prior art lamps.

To obtain the desired beam shape, the lamp according to the invention preferably also comprises an essentially rectangular stripe arranged circumferentially on a surface of the vessel, wherein a first long side of the stripe is situated close to a base or ballast of the lamp, and the width of the stripe is such that a first angle subtended at a lamp centre between a radius and a point on the first long side of the stripe comprises at most 55°, and a second angle subtended at the lamp centre between the radius and a point on a second long side of the stripe comprises at most 50°.

The narrower vertical stripe has a number of positive effects. For example, because the narrower vertical stripe blocks less light, the influence of the vertical stripe on the lamp temperature is not as severe, and the temperature in the lamp does not reach the high levels reached in a prior art lamp with a wider vertical stripe. As already indicated above, the lower temperatures are associated with an improvement in light flux and a less pronounced increase in lamp voltage as the lamp ages. These advantages can be obtained by the simple and economical reduction in the width of the vertical stripe, making use of the fact that the light emitted from 'behind' this vertical stripe would not in any case make any valuable contribution to the beam profile. The reason for this is because the light emitted towards the rear of an enclosing reflector is generally not deflected into the beam, for reasons that will be explained below. This 'superfluous' light, which was unnecessarily blocked in a prior art lamp with a wide vertical stripe, can therefore be safely allowed to exit the lamp in that region between the vertical stripe and the lamp base without detracting from the beam profile.

Usually, a reflector for a front lighting assembly comprises a cut-out area close to the base of the lamp, to allow the lamp base to be connected to the reflector. For example, this location can be part of the lamp base, a flange of the reflector, or even an opening in the back of the reflector. This fact is put to use by the lamp with the vertical stripe according to the invention, since this part of the reflector is therefore generally not used for collecting or deflecting light into the front beam. Any light emitted 'behind' the vertical stripe arrives at this part of the reflector or escapes through an opening in the reflector. Since the light would not be deflected into the beam anyway, there is no need to block it, and the vertical stripe can be made narrower as a result.

In one embodiment of the invention, the vertical stripe entirely surrounds the vessel, i.e. the length of the vertical stripe is essentially equal to the circumference of the vessel so that the vertical stripe is arranged around the entire circumference in a continuous manner.

In order to obtain the beam profile set out in the regulations, a lighting assembly with such a lamp in a reflector generally also comprises a baffle located underneath the lamp to block any light emitted downwards from the lamp. With such a baffle in place, the front beam essentially comprises only light deflected from the upper regions of the reflector. Alternatively, therefore, in another embodiment of the invention, the length of the circumferential or vertical stripe can be shorter than the circumference of the vessel, so that the gap between the ends of the stripe faces 'downwards' towards the baffle.

The lamp according to the invention, with the inventive arrangement of a horizontal stripe and, optionally, a vertical stripe can be realised for various rated power values. For example, by appropriate choice of dimensions, the lamp could be realised as a 35 W D4R lamp. To satisfy regulations, such a lamp could have a (wider) vertical stripe arranged in the prior art manner, while using the inventive horizontal stripe arrangement to improve the beam quality and to prolong the lamp lifetime.

For an optimal light output as well as an advantageously long lifetime, the lamp is preferably realised for a nominal power of 25 W. In a particularly preferred embodiment of a 25 W lamp according to the invention, the lamp comprises an inner discharge vessel enclosed in an outer vessel, whereby the capacity of the inner discharge vessel or burner is between 15 μl and 23 μl, the inner diameter of the inner discharge vessel is between 2.0 mm and 2.4 mm; and the outer diameter of the inner discharge vessel is between 5.2 mm and 5.8 mm.

The stripes could be applied to the inner vessel and/or the outer vessel. For example, a vertical stripe can be applied to the inner vessel, and the outer vessel can have the horizontal stripes. Equally, both vessels can be coated with a partial stripe, so that, in combination, the effect is the same as if only the outer vessel were coated with the stripes. However, since the inner vessel is hottest, any stripe applied to the inner vessel may contribute to an unwanted temperature increase. Furthermore, since the inner vessel is very small and quite bulbous, it may be impracticable to apply a precise stripe. Therefore, in a preferred embodiment of the invention, the partial coating is arranged on an outer surface of the outer vessel, since the outer vessel is essentially a regular cylinder, at least in those regions to which the stripe(s) would be applied.

As explained above, the partial coating can be applied as a pair of essentially rectangular horizontal parallel stripes, one on either side of the lamp, preferably on the outer vessel. For such a realisation of the lamp according to the invention, the width of a longitudinal stripe comprises at most 1.9 mm, more preferably at most 1.7 mm, and most preferably at most 1.5 mm. With such a favourable arrangement of narrow horizontal stripes, the light flux can be increased considerably as already described above. An up to 4% increase in light flux—i.e. about 80 lumen—was observed in measurements taken for a lamp according to the invention. The additional light is emitted in regions that can be very efficiently utilised to illuminate the bright/dark cut-off boundary, thus improving the range of the beam profile. An up to 3% increase in light flux was observed for the inventive lamp with the narrower horizontal stripes after 1500 hours of burning. At the same time, since the area covered by the partial coating is considerably reduced compared to prior art lamps, the temperature of the lamp can be maintained at a favourably lower level, so that chemical reactions in the burner, in which electronegative species such as free iodine are created, will be reduced, so that the increase in lamp voltage is less. In experiments with the lamp according to the invention and comparable prior art lamps, the increase in lamp voltage was observed to be up to 5 V less.

In the prior art lamps, as already mentioned above, the vertical stripe is unfavourably wide, up to 8.3 mm. Not only does this wide stripe unnecessarily block light that would not be included in the beam anyway, the wide stripe also contributes to an increase in lamp temperature. Therefore, in a preferred embodiment of the invention, the width of the circumferential stripe preferably comprises at most 4.5 mm, more preferably at most 4.0 mm, and most preferably at most 3.5 mm. For a 25 W lamp with the above dimensions, the width of the vertical stripe applied to the outside vessel can be as little as 3.5 mm, which is much narrower than the vertical stripe on any comparable prior art lamp, while still ensuring that the relevant regulation is satisfied.

Experiments with a 25 W lamp according to the invention have shown a light output that was surprisingly greater than expected. An explanation for the unexpected increase in light output for the 25 W lamp may be given by its different three-dimensional light intensity distribution owing to the geometry of the lamp vessels and the temperature conditions in the lamp. In the state of the art, the stripes are positioned significantly higher so that the temperature at the bottom of the vessel is lower compared to the situation claimed in this application. In case of a higher cold spot temperature (at the lower part of the vessel) the width of the arc is increased, resulting in higher light intensities particularly in the region of the upper edge of the horizontal pinstripe. Also, the burner of a 25 W lamp has a smaller inner and outer diameter and a smaller electrode distance. This geometry results in a lower temperature gradient between the top and the bottom regions of the burner. Thus the ratio of light radiated out towards the side of the lamp to light radiated towards the top of the lamp is significantly higher for the 25 W lamp. Also, the colour temperature of the light radiated in the direction of the edge of the inventive horizontal pinstripe is significantly higher due to the reduced temperature differences between the upper and lower vessel regions. Even for a 25 W lamp with horizontal pinstripes applied according to the R99 regulations, an increase of about 4% in light output was achieved compared to a comparable 35 W lamp. For the inventive lower placement of the horizontal stripes, the light output was increased by a very favourable 10%.

In addition to the advantages with respect to bulb physics (lamp lifetime, flicker, lamp voltage) the lower placement of the longitudinal pinstripe and the narrower pinstripe width results in a significantly higher beam flux and a significantly higher performance due to the use of additional arc images. These images can be very efficiently used—mainly by the horizontal reflector regions—and can contribute to a longer as well as a wider beam. In this way, the visibility is considerably improved for the driver of the vehicle, while any oncoming vehicles are not subject to an increased level of glare, since the additional arc images are projected below the cut-off line. The beam flux of current reflection-type headlamps can be increased by up to 10%.

The inventive pinstripe arrangement can be favourably used in conjunction with a symmetric baffle and an asymmetric or free-shape reflector, following the technology evolution from asymmetric H4 baffle design to symmetric DFCS baffle design. When a free-shape reflector design is used, neither an asymmetric baffle nor an asymmetric arrangement of horizontal pinstripes is required.

In a preferred embodiment of the invention, the reflector comprises at least one first beam-shaping region on one side of the lamp for deflecting a light portion into a region close to a cut-off boundary of a horizontal region of the beam profile, and at least one second beam-shaping region on the other side of the lamp for deflecting a light portion close to a cut-off boundary of a shoulder region of the beam profile.

In another preferred embodiment of the invention, the reflector comprises an asymmetric arrangement of beam-shaping regions for forming an asymmetric beam profile with light collected from an essentially symmetrical light source. A reflector with such an asymmetric geometry or surface topology can then optimally be used with a lamp having a symmetrical arrangement of horizontal stripes, while still producing an asymmetric front beam as required by the regulations.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
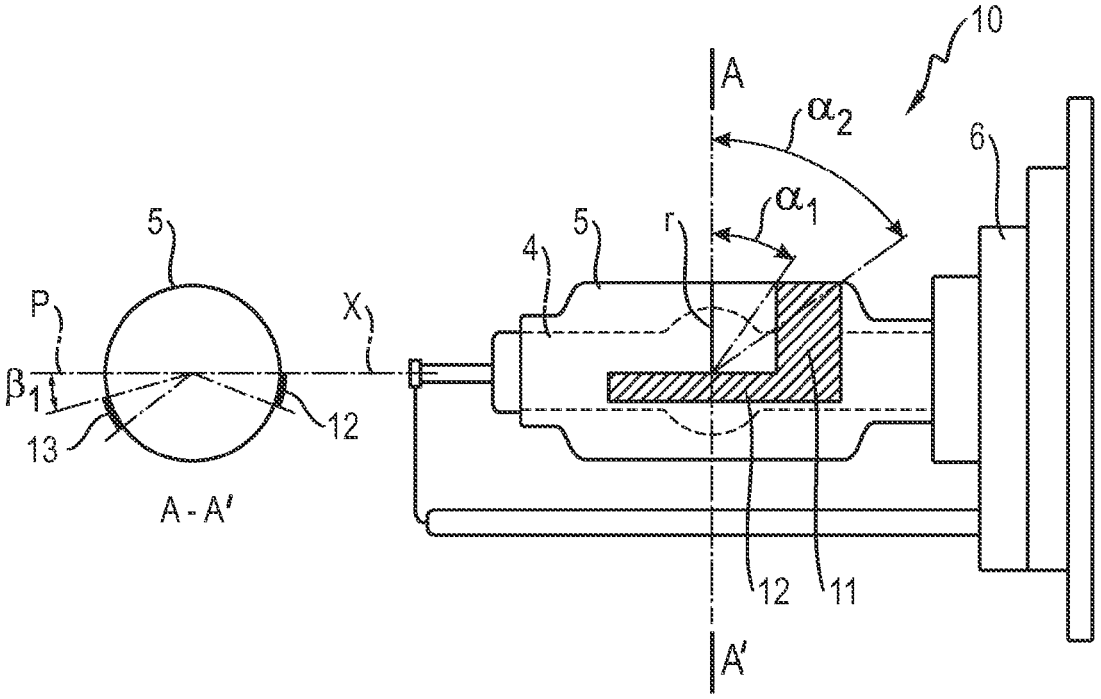
FIG. 1 (Prior art)
FIG. 1 shows a schematic representation of a prior art gas-discharge lamp.

FIG. 1 shows a cross section of a prior art gas-discharge lamp 10, with a partial coating 11, 12 comprising a circumferentially arranged stripe 11 and a pair of longitudinally arranged stripes 12, 13. The lamp 10 shown corresponds to a D4R lamp, with a ballast 6 or base 6, for use in an automotive headlight assembly. The width of the circumferential stripe 11 is defined in the appropriate regulation, in this case ECE R99, by the angles $\alpha_1$, $\alpha_2$ subtended at the lamp centre between a radius r and points on the outer edges of the circumferential stripe 11. The regulation ECE R99 requires that the smaller angle $\alpha_1$ be 45°±5°, and that the larger angle $\alpha_2$ be at least 70°. On a D4R lamp, such a circumferential stripe 11 can therefore have a width of about 8.3 mm, and usually covers a substantial part of the underlying pinch region. A pair of longitudinal stripes 12, 13 is arranged one of each side of the lamp 10. This is illustrated in the cross-section A-A' shown on the left of the diagram. According to the regulation ECE R99, these longitudinal stripes 12, 13 are arranged asymmetrically on the lamp outer vessel 5 such that one stripe 13 is lower than the other stripe 12. The 'higher' stripe 12 is positioned to lie just below the horizontal plane P, while the upper edge of the lower stripe 13 is positioned at most 15° below the horizontal plane P. The reason for this arrangement is the older reflector designs, which required an asymmetric light source in order to produce the required asymmetric front beam. However, this known prior art arrangement of stripes 11, 12, 13 leads to the problems mentioned above, namely a shorter lamp lifespan (owing to the excessive heat that develops in the pinch region under the circumferential stripe 11), an uneven light intensity distribution in the beam profile (owing to the pronounced temperature gradient between the upper and lower regions of the lamp 1), and a lower light output (owing to the light lost in the areas blocked by the longitudinal stripes 12, 13).

Figure 2:
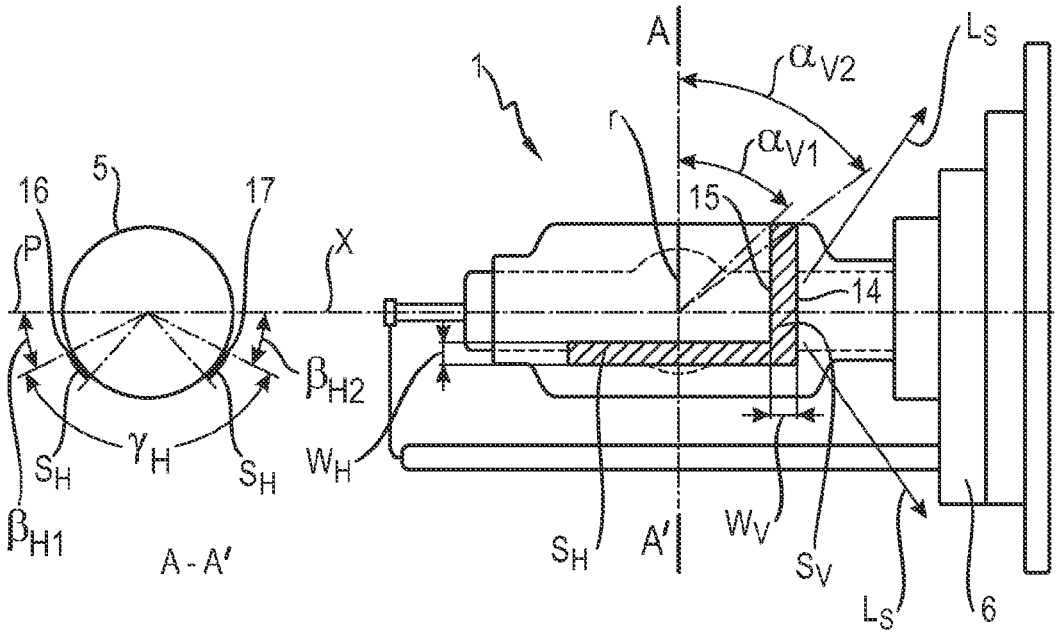
FIG. 2 shows a schematic representation of a gas-discharge lamp according to a first embodiment of the invention.

FIG. 2 shows a gas-discharge lamp 1 according to a first embodiment of the invention. The construction of the lamp 1 is essentially the same as in the above FIG. 1, in order to comply with regulations regarding lamp size, ballast, etc. The relative sizes of the inner and outer vessels 4, 5 will depend on whether the lamp is realised as a 25 W lamp or a 35 W lamp. In this embodiment, two horizontal stripes $S_H$ are arranged symmetrically on the outer vessel 5. In contrast to the horizontal stripes 12, 13 of FIG. 1, the horizontal stripes $S_H$ are arranged symmetrically on either side of the lamp 1, are positioned lower down, and are narrower than the prior art stripes 12, 13. This is illustrated in the cross-section A-A' shown on the left of the diagram. In this embodiment, the longitudinal stripes $S_H$ are arranged symmetrically on the lamp outer vessel 5 such that an angle $\beta_{H1}$, $\beta_{H2}$ subtended at the lamp centre between the horizontal plane P and a point on an upper edge 16, 17 of a longitudinal stripe $S_H$ comprises 15°. The angular region $\gamma_H$ between the upper edges 16, 17 of the horizontal stripes $S_H$ and below the horizontal plane P comprises only 150°. As a result, the light output of the lamp 1 is increased, since less light is blocked by the lower and narrower longitudinal stripes $S_H$, and more 'useful' arc images can be collected by a surrounding reflector and used to form a brighter front beam, as will be shown below.

The diagram also shows a rectangular vertical stripe $S_V$ arranged about the circumference of the outer vessel 5 of the lamp 1, such that the short ends of the vertical stripe $S_V$ do not meet on the underside of the lamp 1. The width $w_V$ of the vertical stripe $S_V$ is defined by the angles $\alpha_{V1}$, $\alpha_{V2}$ subtended between a radius r through the lamp centre and points on the outer edges 14, 15 of the circumferential stripe $S_V$. In this embodiment of the invention, the smaller angle $\alpha_{V1}$ to the inner edge 15 closer to the burner 4 is about 50°, and the larger angle $\alpha_{V2}$ to the outer edge 14 closer to the base 6 is only about 55°. Therefore, the vertical stripe $S_V$ has a width $w_V$ of about 3.5 mm, so that it only covers a small section of the underlying pinch region. During operation of the lamp, then, 'superfluous' light $L_S$ (light that would not be used in any case to contribute to the front beam) can leave the lamp 1 without being absorbed or reflected back into the lamp 1, and therefore the temperature in the lamp is not unnecessarily increased.

Figure 3:
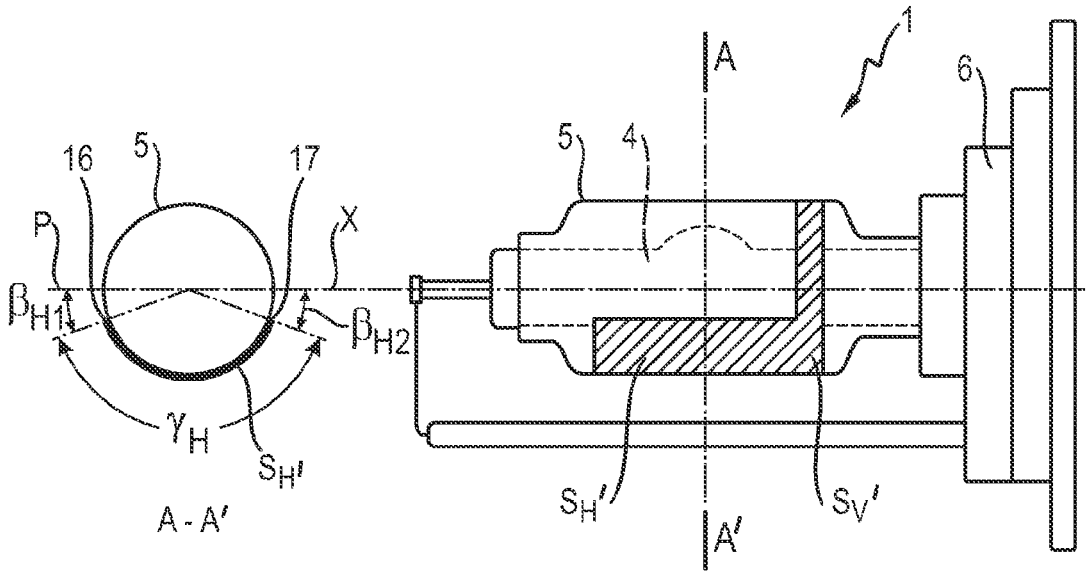
FIG. 3 shows a schematic representation of a gas-discharge lamp according to a second embodiment of the invention.

FIG. 3 shows a further embodiment of a lamp 1 according to the invention. Here, a vertical stripe $S_V'$ and a horizontal stripe $S_H'$ are arranged as shown on the outer surface of the outer vessel 5. In this realisation, the vertical stripe $S_V'$ extends all the way around the outer vessel 5, and the horizontal stripe $S_H'$ comprises a single stripe $S_H'$. The position and width of the vertical stripe $S_V'$ can be the same as in FIG. 2 above. In this embodiment, the defining angle $\beta_{H1}$, $\beta_{H2}$ of the horizontal stripe $S_H'$ can be smaller, for example 10°, as shown in the cross-section A-A' on the left of the diagram. In this case, the angular region $\gamma_H$ between the upper edges 16, 17 of the horizontal stripes $S_H$ comprises 160°.

In prior art lamps, the stripes were required to provide an asymmetric light source, and the prior art reflectors were largely symmetrical. The lamp 1 according to the invention makes use of the fact that the reflectors available at present can be favourably designed to form light—even light originating from a symmetrical light source—into an asymmetric front beam. Since the reflector can achieve the required asymmetry largely on its own, the width and placement of the stripes can be favourably adjusted as described above to optimise the light output and to prolong the lamp lifetime.

Figure 4:
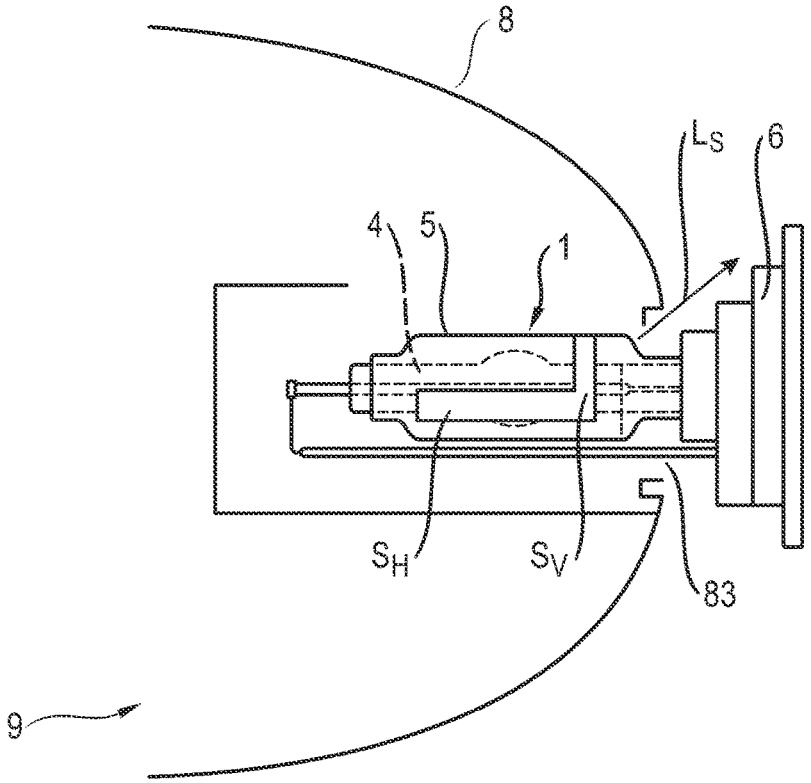
FIG. 4 shows a lighting assembly according to an embodiment of the invention.

FIG. 4 shows a lighting assembly 9 with a lamp 1 according to the invention and a reflector 8. As can be seen clearly in the diagram, the circumferential stripe $S_V'$ is narrow, so that light $L_S$, which is in any case superfluous, can pass through the outer vessel 5 into the base region of the lamp 1. This light can, for example, be absorbed in the rear of the reflector 8 or can pass through an opening 83 in the rear of the reflector 8. 'Wasting' the superfluous light $L_S$ in this way does not detract from the beam quality. Instead, the lamp 1 is protected from overheating by the narrow width of the vertical stripe $S_V'$.

Figure 5:
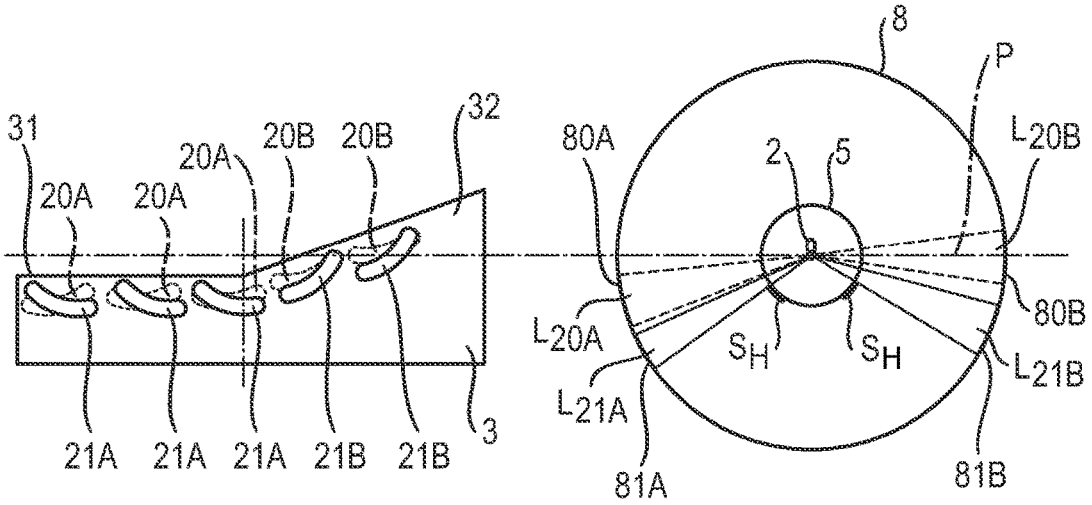
FIG. 5 shows a cross section through a lighting assembly according to the invention and a corresponding beam profile.

FIG. 5 illustrates the beneficial effect of the inventive arrangement of horizontal stripes $S_H$ on a lamp 1 in a reflector 8 for an automotive headlamp arrangement. On the right-hand side of the diagram, a cross-section through the lamp 1 and reflector 8 is shown, and regions 80A, 80B, 81A, 81B are indicated on the inside surface of the reflector 8. Images 20A, 20B, 21A, 21B of the discharge arc 2 originating from light $L_{20A}$, $L_{20B}$, $L_{21A}$, $L_{21B}$ collected at these regions 80A, 80B, 81A, 81B, are projected onto the beam profile 3 according to the relevant regulation, for example R98, as shown in the left-hand side of the diagram. Images 20A, 20B (dotted lines) show the region close to the cut-off 31 and in the shoulder 32 that can be illuminated with a prior art lamp having higher horizontal stripes. Because these arc images 20A, 20B are collected relatively high up in the reflector 8, near to or above the horizontal plane P, they are not tilted to any significant extent, and lie more or less along the cut-off line of the beam profile 3. The additional images 21A, 21B (solid lines) that are projected into the beam profile 3 ensure a better illumination by the front beam owing to the greater light flux and the longer reach of the front beam. These additional images 21A, 21B are collected on account of the inventive lower arrangement of longitudinal stripes $S_H$ on the outer vessel 5. Because these images 21A, 21B are collected lower down in the reflector 8, they are tilted noticeably compared to the other arc images 20A, 20B, and make a favourable contribution to the overall brightness of the beam profile.

Figure 6:
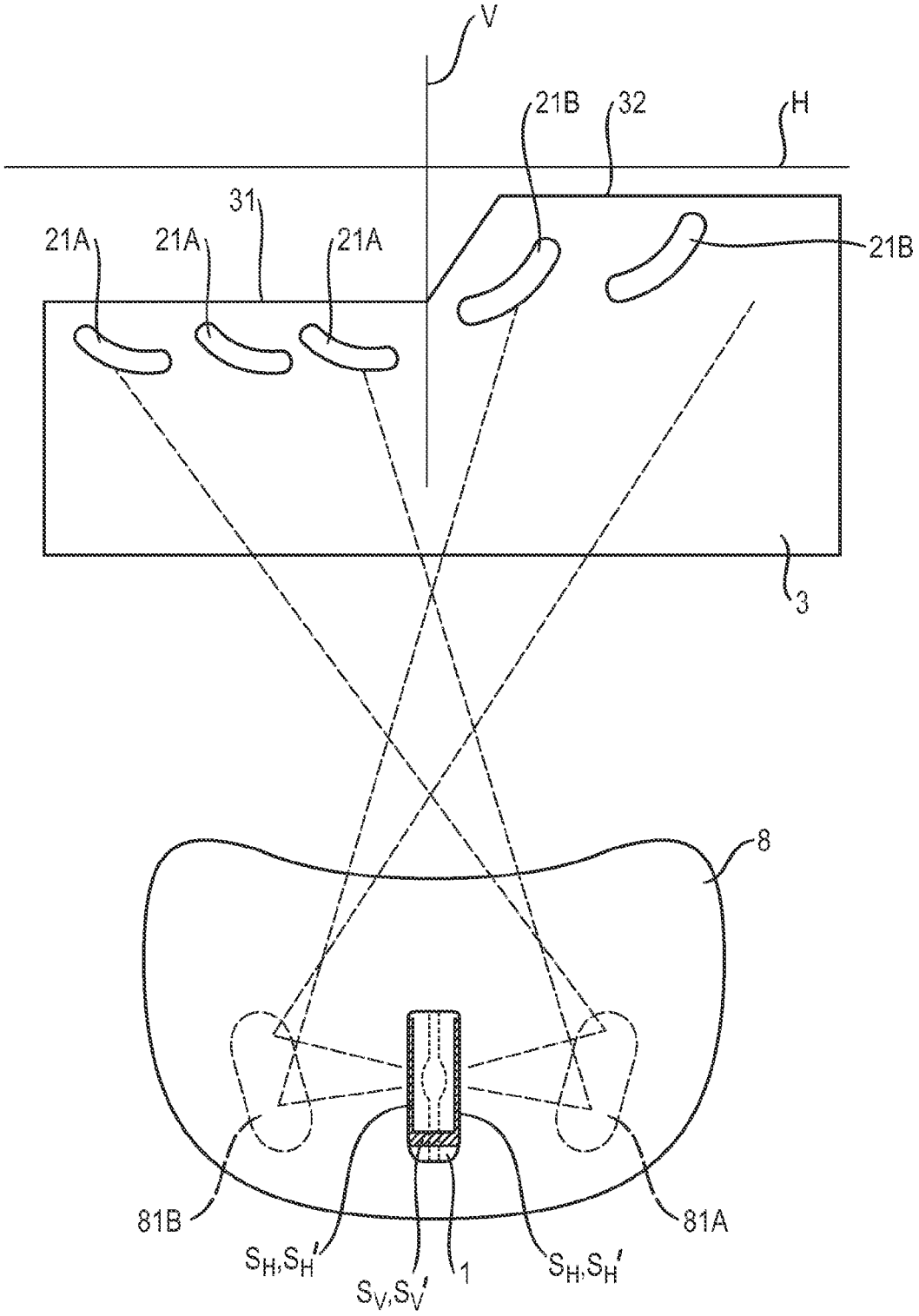
FIG. 6 shows a schematic representation of a reflector according to the invention.

FIG. 6 shows a view of a reflector 8 according to the invention. Here, a lamp 1 with a stripe arrangement $S_V$, $S_V'$, $S_H$, $S_H'$ according to the invention is mounted horizontally in the reflector. Images of the discharge arc 2, collected in the interior of the reflector 8, are deflected outward to give a beam profile 3 with a desired cut-off line 31 and a 'shoulder' 32 relative to axes H, V. The diagram shows the regions 81A, 81B for collecting additional light $L_{21A}$, $L_{21B}$ allowed by the lower placement of horizontal stripes $S_H$, $S_H'$. This additional light is deflected onto the beam profile as the arc images 21A, 21B. The positions and orientations of these additional arc images 21A, 21B in the diagram is exemplary. The position of the horizontal stripe(s) $S_H$, $S_H'$ and the actual realisation of the reflector regions 81A, 81B will influence the orientation and positioning of the arc images 21A, 21B. For example, a lower placement of the horizontal stripe(s) $S_H$, $S_H'$ will result in a more tilted arc image 21A, 21B. Using this reflector 8 with the inventive lamp 1 allows a better illumination of the region in front of the vehicle between 25 m and 60 m owing to the improved reach of the beam and to the better illumination in the cut-off 31 and shoulder 32 regions of the beam profile 3.

Figure 7:
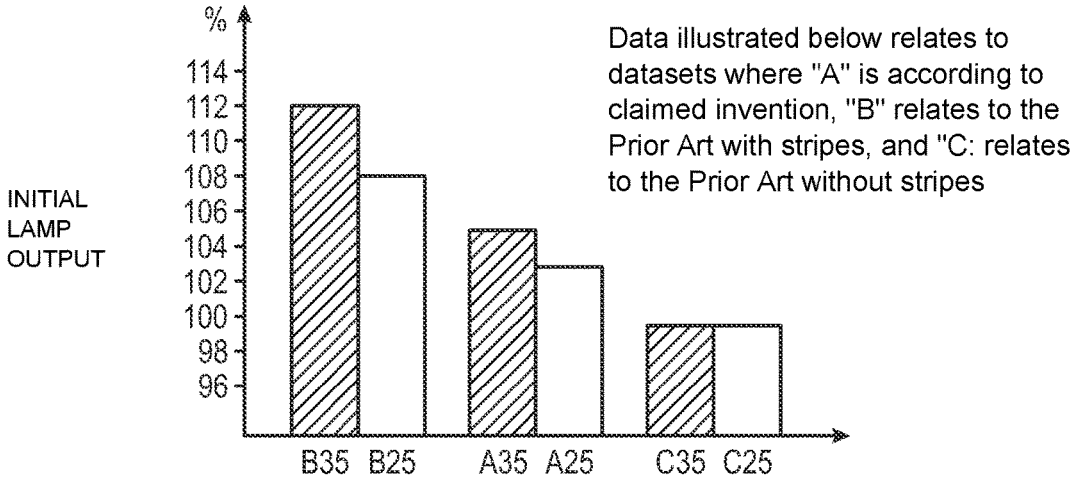
FIG. 7 shows a bar chart of initial lumen output.
Figure 8:
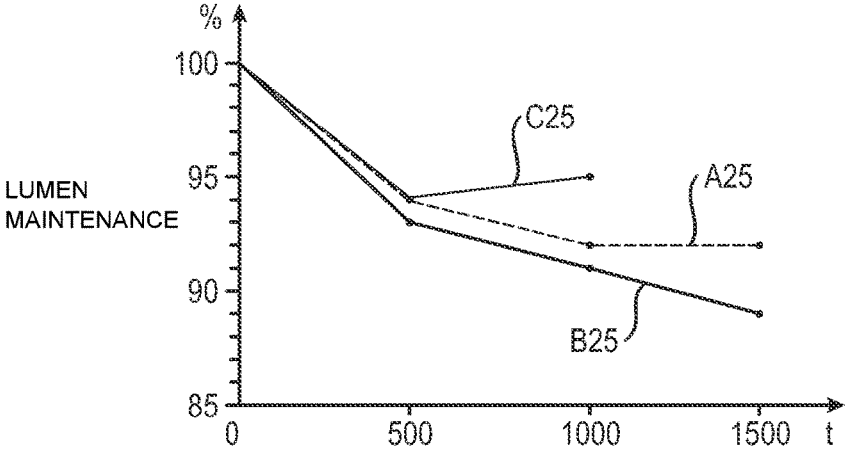
FIG. 8 shows graphs of lumen maintenance.
Figure 9:
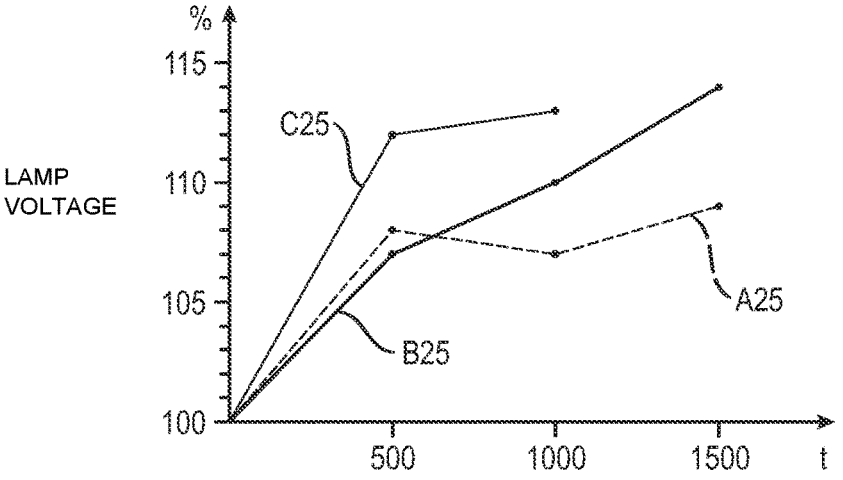
FIG. 9 shows graphs of lamp voltage.

FIGS. 7-9 show experimental results obtained for 35 W and 25 W D4R lamp batches A35, A25 according to the invention, for D4R 35 W and 25 W lamp batches B35, B25 with a prior art pinstripe arrangements, and for D4R 35 W and 25 W lamp batches C35, C25 with no pinstripes.

FIG. 7 shows a bar chart of initial lumen output in percent (%) for different batches of automotive gas-discharge lamps measured 15 hours after burning in. Batch B35 comprised prior art 35 W lamps with pinstripes arranged according to the R99 regulation, while batch B25 comprised prior art 25 W lamps with such pinstripes.

Batches C35, C25 comprised 35 W and 25 W D4R lamps respectively, without any stripes. To satisfy the regulation, an automotive lamp 25 W or 35 W lamp must deliver 3200±450 lumens at 15 hours after burning in. The light output that can be achieved initially is given as 100%. Batch A35 comprised 35 W lamps and batch A25 comprised 25 W lamps, in each case with horizontal stripes arranged according to the invention, i.e. lower down and narrower, and a narrow vertical stripe. For these batches, improvements in light output of 5% and 3% respectively were obtained. Evidently, since the absence of any stripes means no light is blocked, the light output for batches C35, C25 are highest, and these are only given as a reference against which the favourable improvements of batches A35 and A25 can be compared. As the chart shows, the lamp according to the invention, while having stripes to assist in obtaining a desired beam shape, can still provide an initial lumen output favourably close to that of a lamp without any stripes.

FIG. 8 shows graphs of lumen maintenance measured for the lamp type batches A25, B25, C25 of FIG. 1 after 1500 hours of burning. An initial value of 100% corresponds to the lumen output of each lamp batch type after burning in. Lamp type batch B25 showed relatively poor lumen maintenance, dropping to only about 89% of its initial value after 1500 hours. Batch A25 showed quite favourable lumen maintenance, dropping only to about 92%. The lamp batch C25, without any partial coating, dropped to about 95%, so that the lumen maintenance of lamp type batch A25 compares quite well to a lamp type without any stripes. In the 25 W lamp, the burner is small, but the outer vessel is of the same size as for a 35 W lamp. Therefore, the clearance between burner and outer vessel is greater, and the coefficient of thermal conductivity is lower. The burner is therefore to some extent thermally insulated from the outer vessel, so that heat generated because of the stripe regions does not affect the temperature in the burner to the same extent as in a prior art 35 W lamps. This explains the very favourable lumen maintenance of the 25 W lamps according to the invention. Measurements taken for the lamp batches A35, B35, C35 showed a drop in lumen maintenance to 82%, 72% and 87% respectively after 2000 hours of burning, so that the 35 W lamp A35 with the inventive pinstripe arrangement exhibited a favourable lumen maintenance compared to a prior art lamp B35 with pinstripes.

FIG. 9 shows graphs of lamp voltage measured for batches A25, B25, C25 of FIG. 7 and FIG. 8 after 1500 hours of burning. An initial value of 100% corresponds to the lamp voltage of each lamp batch type after burning in. Lamp batch B25 showed a marked increase in lamp voltage after 1500 hours, rising to about 114%. The lamp voltage of lamp batch C25, without any stripes, increased to about 113%. Lamp batch A25 showed a very favourably low increase in lamp voltage, which rose to only about 109%. Positive effects of the low increase in lamp voltage are a reduced tendency to flicker and a prolonged lamp lifetime. Owing to the better thermal insulation of the inner vessel, the temperature in the 25 W lamp according to the invention can be maintained at a favourably low level, which explains the slower increase in lamp voltage even compared to a 35 W lamp with inventive stripe arrangement. Measurements taken for the lamp batches A35, B35, C35 showed an increase in lamp voltage of 127%, 131% and 135% respectively after 2000 hours of burning, so that the 35 W lamp with the inventive pinstripe arrangement exhibited the lowest percent increase in lamp voltage over lamp lifetime.

Although the present invention has been disclosed in the form of preferred embodiments and variations thereon, it will be understood that numerous additional modifications and variations could be made thereto without departing from the scope of the invention. For the sake of clarity, it is also to be understood that the use of "a" or "an" throughout this application does not exclude a plurality, and "comprising" does not exclude other steps or elements.

The invention claimed is:

1. A lighting assembly for a reflection-type automotive headlamp, comprising:

a reflector, and a gas-discharge lamp mounted horizontally in the reflector such that a longitudinal axis (X) through a lamp center is horizontal, the lamp comprising:

a vessel will a partial coaling comprising first and second longitudinal opaque stripes ($S_H$) arranged on a surface of the vessel, wherein, as seen in the lamp's horizontal mounting position:

the first longitudinal opaque stripe is located on a first side of the lamp below a horizontal plane (P) through the longitudinal axis (X);

the second longitudinal opaque stripe is located on a second side of the lamp below the horizontal plane (P);

a first angle ($\beta_{H1}$) subtended at the lamp center by the horizontal plane (P) and a first upper edge of the first longitudinal opaque stripe ($S_H$) is essentially the same as a second angle ($\beta_{H2}$) subtended at the lamp center by the horizontal plane (P) and a second upper edge of the second longitudinal opaque stripe ($S_H$); and the first and the second angles comprise 10° to 15°; and the reflector comprising a reflective interior surface with beam shaping regions to deflect light originating from the lamp outward to give a beam profile with a bright/dark cut-off line and a shoulder, wherein the reflection interior surface comprises at least one beam-shaping region realized to deflect a portion ($L_{21A}$, $L_{21B}$) of the light, emitted from the lamp in an angular range between 7.5° and 15° below the horizontal plane (P), to form an image within the beam profile having a greater tilt than another image formed by another beam-shaping region that deflects another portion of the light, emitted from the lamp in another angular range above the angular range between 7.5° and 15° below the horizontal plane.

2. The lighting assembly according to claim 1, wherein the partial coating further comprises a circumferential opaque stripe ($S_V$) arranged circumferentially on the surface of the vessel.

3. The lamp lighting assembly according to claim 2, wherein the length of the circumferential stripe ($S_V$) is shorter than the circumference of the vessel.

4. The lighting assembly according to claim 2, wherein a width ($w_V$) of the circumferential stripe ($S_V$) comprises 3.5 to 4.5 mm.

5. The lighting assembly according to claim 1, wherein the reflector comprises at least one first beam-shaping region on one side of the lamp for deflecting a light portion ($L_{21A}$) into a region close to a cut-off boundary of the beam profile, and at least one second beam-shaping region on the other side of the lamp for deflecting a light portion ($L_{21B}$) close to a cut-off boundary of a shoulder region of the beam profile.

6. The lighting assembly according to claim 1 with the lamp with a nominal power of 25 W, which lamp comprises an inner discharge vessel enclosed in an outer vessel, and for which lamp the capacity of the inner discharge vessel is greater than or equal to 15 μl and less than or equal to 23 μl ;

the inner diameter of the inner discharge vessel comprises at least 2.0 mm and at most 2.4 mm; and the outer diameter of the inner discharge vessel comprises at least 5.2 mm and at most 5.8 mm.

7. The lighting assembly according to claim 1, wherein the first and the second longitudinal opaque stripes ($S_H$) are arranged on an outer surface of an outer vessel of the lamp.

8. The lighting assembly according to claim 1, wherein the first and the second longitudinal opaque stripes ($S_H$) are essentially rectangular and each having a width ($w_H$) comprising 1.5 to 1.9 mm.

9. A lighting assembly for a reflector-type automotive headlight, comprising: a reflector; and a gas-discharge lamp mounted horizontally in the reflector such that a longitudinal axis (X) through a lamp center is horizontal, the lamp comprising:

a vessel with a partial coating comprising a single longitudinal opaque stripe ($S_H'$) arranged on a surface of the vessel, wherein, as seen in the lamp's horizontal mounting position:

the longitudinal opaque stripe is located below a horizontal plane (P) through the longitudinal axis (X);

a first angle ($\beta_{H1}$) subtended at the lamp center by the horizontal plane (P) and a first upper edge of the longitudinal opaque stripe ($S_H'$) on a first side of the lamp is essentially the same as a second angle ($\beta_{H2}$) subtended at the lamp center by the horizontal plane (P) and a second upper edge of the longitudinal opaque stripe ($S_H'$) on a second side of the lamp; and the first and the second angles comprise 10° to 15° ; and the reflector comprising a reflective interior surface with beam-shaping regions to deflect light originating from the lamp outward to give a beam profile with a bright/dark cut-off line and a shoulder, wherein the reflective interior surface comprises at least one beam-shaping region that deflects a portion of the light, emitted from the lamp in an angular range between 7.5° and 15° below the horizontal plane, to form an image within the beam profile having a greater tilt than another image formed by another beam-shaping region that deflects another portion of the light, emitted from the lamp in another angular range above the angular range between 7.5° and 15° below the horizontal plane.

10. The lighting assembly according to claim 9, wherein the partial coating further comprises a circumferential opaque stripe ($S_V'$) arranged circumferentially on the surface of the vessel.

11. The lighting assembly according to claim 10, wherein the circumferential stripe ($S_V'$) entirely surrounds the vessel.

12. The lighting assembly according to claim 10, wherein a width ($w_V$) of the circumferential stripe ($S_V'$) comprises 3.5 to 4.5 mm.

13. The lighting assembly according to claim 9 with the lamp with a nominal power of 25 W, which lamp comprises an inner discharge vessel enclosed in an outer vessel, and for which lamp the capacity of the inner discharge vessel is greater than or equal to 15 μl and less than or equal to 23 μl;

the inner diameter of the inner discharge vessel comprises at least 2.0 mm and at most 2.4 mm; and the outer diameter of the inner discharge vessel comprises at least 5.2 mm and at most 5.8 mm.

14. The lighting assembly according to claim 9, wherein the longitudinal opaque stripe ($S_H'$) is arranged on an outer surface of an outer vessel of the lamp.

15. The lighting assembly according to claim 9, wherein the reflector comprises at least one first beam-shaping region on one side of the lamp for deflecting a light portion ($L_{21A}$) into a region close to a cut-off boundary of the beam profile, and at least one second beam-shaping region on the other side of the lamp for deflecting a light portion ($L_{21s}$) close to a cut-off boundary of a shoulder region of the beam profile.

16. A gas-discharge lamp comprising a vessel with a partial coating comprising at least one longitudinal opaque stripe ($S_H$, $S_H'$) arranged on a surface of the vessel below a horizontal plane (P) through a longitudinal axis (X) through the center of the lamp such that, on each side of the lamp, an angle ($\beta_{H1}$, $\beta_{H2}$) subtended at the lamp center by the horizontal plane (P) and an upper edge of the longitudinal opaque stripe ($\beta_H$, $S_H'$) on that side of the lamp comprises 10° to 15°, wherein:

the partial coating further comprises a circumferential opaque stripe ($S_V$, $S_V'$) arranged circumferentially on the surface of the vessel; and the circumferential stripe ($S_V$, $S_V'$) is arranged such that a first long side of the circumferential stripe ($S_V$, $S_V'$) is situated close to a base (6) of the lamp, and the width of the circumferential stripe ($S_V$, $S_V'$) is such that a first angle ($\alpha v_1$) subtended at the lamp center between a radius (r) and a point on the first long side of the circumferential stripe ($S_V$, $S_V'$) comprises at most 55°, and a second angle ($\alpha v_2$) subtended at the lamp center between another radius (r) and a point on a second long side of the circumferential stripe ($S_V$, $S_V'$) comprises approximately 50°.

17. The lamp according to claim 16, wherein the circumferential stripe ($S_V'$) entirely surrounds the vessel or the length of the circumferential stripe ($S_V$) is shorter than the circumference of the vessel.

18. The lamp assembly according to claim 17, wherein a width ($w_V$) of the circumferential stripe comprises 3.5 to 4.5 mm.

* * * * *